US005876510A

United States Patent [19]

Kuemin et al.

[11] Patent Number: 5,876,510

[45] Date of Patent: Mar. 2, 1999

[54] PROCESS FOR CLEANING ARTICLES

[75] Inventors: Marius A. M. Kuemin, Huenenberg; Michael Schneider, Horgen, both of Switzerland

[73] Assignee: The Dow Chemical Company, Midland, Mich.

[21] Appl. No.: 894,108

[22] PCT Filed: Mar. 4, 1996

[86] PCT No.: PCT/US96/02900

§ 371 Date: Aug. 12, 1997

§ 102(e) Date: Aug. 12, 1997

[87] PCT Pub. No.: WO96/28535

PCT Pub. Date: Sep. 19, 1996

[30] Foreign Application Priority Data

Mar. 9, 1995 [GB] United Kingdom ..... 9505055

[51] Int. Cl.[6] ..... B08B 3/08; B08B 3/04

[52] U.S. Cl. ..... 134/12; 134/2; 134/10; 134/26; 134/40

[58] Field of Search ..... 134/2, 12, 26, 134/40, 11, 31, 42, 10, 108, 109

[56] References Cited

U.S. PATENT DOCUMENTS

| | | | |
|---|---|---|---|
| 3,982,325 | 9/1976 | Sigl et al. | 34/9 |
| 5,271,773 | 12/1993 | Hamilton et al. | 134/10 |
| 5,300,154 | 4/1994 | Ferber et al. | 134/26 |

FOREIGN PATENT DOCUMENTS

| | | | |
|---|---|---|---|
| 0194589 | 9/1986 | European Pat. Off. | C23G 5/02 |
| 0474053 | 3/1992 | European Pat. Off. | C23G 5/024 |
| 0611214 | 8/1994 | European Pat. Off. | C11D 7/50 |

OTHER PUBLICATIONS

Derwent Abstract, "Dewatering Porous Glass—by Introducing Water Immiscible Solvent to From Azeotropic Vapour Mixture," JP 61127632; Japan.

Derwent Abstract, Detergent Composition for Degreasing—Comprises Propylene Glycol–Based Solvent, e.g. Propylene Glycol Mono–n–Butyl Ether, and Water, JP 6146041; Japan.

*Primary Examiner*—Zeinab El-Arini

[57] ABSTRACT

The invention relates to a process for cleaning one or more articles which includes the steps of:

I) contacting the article(s) with a cleaning agent containing
   a) from 0.01 to 80 weight percent of water and
   b) from 99.99 to 20 weight percent of an organic solvent having the features of:
      i) forming an azeotrope with water, and
      ii) forming a separate phase after azeotropic distillation, the amounts of a) and b) being based on the total weight of a) and b), II) rinsing one or more cleaned articles with a rinsing agent containing from 99.99 to 60 weight percent of water and from 0.01 to 40 weight percent of said organic solvent, based on the total weight of the rinsing agent, whereby the rinsing agent has a higher water content than the cleaning agent, III) combining at least a portion of the cleaning agent used in step I) and at least a portion of the rinsing agent used in step II) and subjecting the combined cleaning agent and rinsing agent to an azeotropic distillation to recover an azeotrope, separating the azeotrope into a water-rich phase and a solvent-rich phase and recycling at least a portion of the solvent-rich phase to step I) and recycling at least a portion of the water-rich phase to step II).

The invention also relates to a cleaning agent and a means for cleaning and rinsing articles.

15 Claims, 1 Drawing Sheet

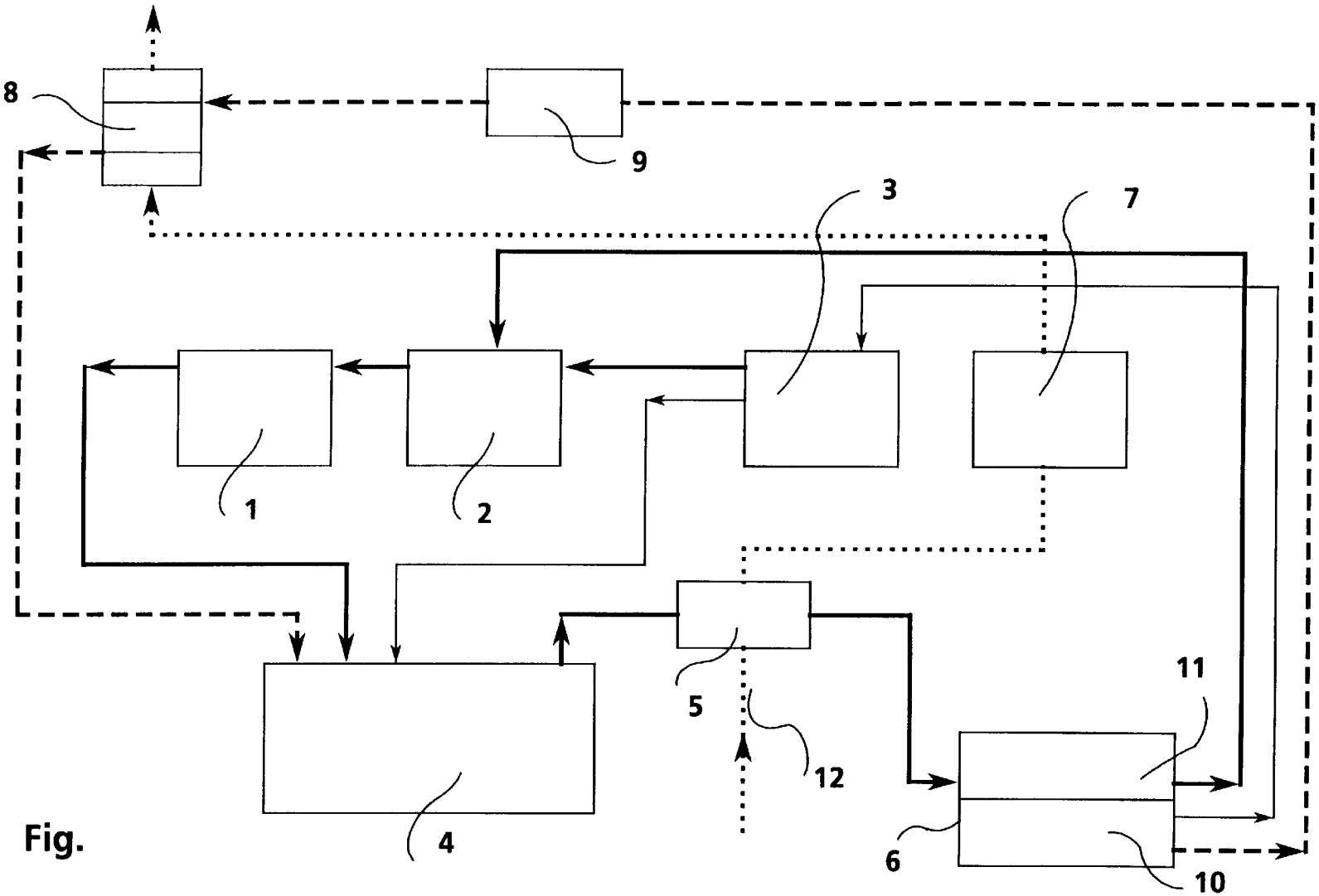
Fig.

PROCESS FOR CLEANING ARTICLES

This is a national stage application of PCT/US96/02900 filed Mar. 4, 1996.

The process of the present invention relates to a process for cleaning one or more articles.

FIELD OF THE INVENTION

In many industrial processes articles have to be cleaned, either during finishing or prior to further processing, in order to remove impurities like grease, salts or other water-soluble or water-insoluble impurities from the articles. For example, articles with hard surfaces, such as glass, metallic or polymeric surfaces, often undergo one or more cleaning operations during production, finishing or recycling processes. Organic solvents are frequently used due to their excellent cleaning capability and fast evaporation rate. Depending on the type of organic solvent, it is advisable to take precautions to minimize the release of the organic solvent to the environment. Aqueous cleaning compositions are also known. The main component of aqueous cleaning compositions is water which is mixed with active ingredients, such as bases or acids, surfactants, builders, in some cases a minor amount of one or more organic solvents and small amounts of optional additives. One disadvantage of these aqueous compositions is their usually long evaporation time. Another disadvantage is that such aqueous compositions often leave residues on the article, which is not acceptable if high purity of the article is required. Therefore, in the metal working industry, in the optical industry or in other industries it is common to rinse articles with water of high purity after the last cleaning step if the articles have been cleaned with an aqueous cleaning composition and if high purity of the articles is required. Unfortunately, the evaporation rate of water alone is very low. Either the articles dry very slowly or much energy is required for forced drying of the articles if the drying time is to be reduced.

DESCRIPTION OF THE PRIOR ART

U.S. Pat. No. 5,271,773 discloses a process for cleaning articles with an aqueous solution of terpene. The aqueous solution of terpene is said to effectively clean water-insoluble contaminants, and upon settling, to quickly release contaminants from the wash solution. The articles contaminated with water-insoluble materials are cleaned as follows: (a) they are contacted with an aqueous solution comprising 1.86 to 37.2 volume percent of a terpene and 0.14 to 2.8 volume percent of a surfactant, (b) removed contaminants are allowed to separate from the aqueous solution and (c) the terpene is separated from water which may then be used to rinse the articles. The U.S. Patent teaches that the separated aqueous solution which comprises terpene, surfactant and some residual amounts of contaminant can be directly recycled to clean the articles. However, high purity cannot be achieved with this method. Alternatively, the aqueous composition can be subjected to a filtration for separating terpene and surfactant. Unfortunately, in many applications the purity of the recovered water is still not sufficient for rinsing the cleaned articles.

Accordingly, one object of the present invention is to provide a process for cleaning one or more articles by which high purity of the articles is achieved. A preferred object of the present invention is to provide an efficient cleaning process which does not make use of a substantial amount of halogenated solvents.

SUMMARY OF THE INVENTION

One aspect of the present invention is a process for cleaning one or more articles which comprises the steps of:

I) contacting the article(s) with a cleaning agent containing, based on the total weight of a) and b), a) from 0.01 to 80 weight percent of water and b) from 99.99 to 20 weight percent of an organic solvent having the features of:

i) forming an azeotrope with water, and ii) forming a separate phase after azeotropic distillation, II) rinsing one or more cleaned articles with a rinsing agent containing from 99.99 to 60 weight percent of water and from 0.01 to 40 weight percent of said organic solvent, based on the total weight of the rinsing agent, whereby the water content in the rinsing agent is higher than the water content in the cleaning agent, III) combining at least a portion of the cleaning agent used in step I) and at least a portion of the rinsing agent used in step II) and subjecting the combined liquid to an azeotropic distillation, separating the azeotrope into a water-rich phase and a solvent-rich phase and recycling at least a portion of the solvent-rich phase to step I) and recycling at least a portion of the water-rich phase to step II), and IV) optionally drying the rinsed article(s).

Another aspect of the present invention is a cleaning apparatus which comprises one or more containers provided with the above-mentioned cleaning agent, one or more containers provided with the above-mentioned rinsing agent, a distillation device, a condenser and a liquid/liquid separator.

Yet another aspect of the present invention is a means for cleaning and rinsing articles comprising A) a container provided with the above-mentioned cleaning agent and B) a container provided with the above-mentioned rinsing agent.

BRIEF DESCRIPTION OF THE DRAWING

The FIGURE is a schematic illustration of a preferred cleaning process and cleaning apparatus.

DESCRIPTION OF THE PREFERRED EMBODIMENTS

The process, apparatus and means of the present invention are particularly useful for cleaning articles which have a hard surface, for example a surface which is partially or fully made of wood, or preferably metal, ceramic, fiberglass, glass or plastics. Metallic surfaces can for example be made of aluminum, steel, copper, brass, or alloys thereof. Metallic articles are for example parts of automobiles, airplanes, railroad cars, metal components used in high technology industries, precision metal parts, printed circuit boards or containers, such as food or beverage containers.

In step I) of the process of the present invention one or more articles are contacted with a cleaning agent which contains a) from 0.01, preferably from 1, more preferably from 2, most preferably from 5 weight percent, and up to 80, preferably up to 60, more preferably up to 50, most preferably up to 40 weight percent of water and b) from 99.99, preferably from 99, more preferably from 98, most preferably from 95 weight percent, to 20, preferably to 40, more preferably to 50, most preferably to 60 weight percent of an organic solvent described in more detail below. The percentages of a) and b) are based on the total weight of a) and b). The percentage of water in the cleaning agent may be higher than its solubility in the organic solvent at the given cleaning temperature; in this case the cleaning agent is an emulsion. The cleaning agent used in step I) may contain other components described further below. Generally, the total weight of the components a) and b) amount to at least 75 percent, preferably at least 90 percent, more preferably at least 95 percent, most preferably at least 99 percent of the total weight of the cleaning agent. The process of the present invention can be handled most conveniently if the cleaning agent only consists of a) and b).

By "organic solvent" is meant an organic compound or a mixture of two or more organic compounds which has the following features:

i) it forms an azeotrope with water at about atmospheric pressure, and ii) it forms a separate phase after azeotropic distillation; this means that two phases, a water-rich phase and a solvent-rich phase, are formed when the azeotrope is condensed. It is not essential that the phase separation occurs at room temperature, it is sufficient that the phase separation occurs at a temperature in the range of from 20° C. to 98° C., preferably from 40° C. to 85° C., most preferably from 40° C. to 65° C.

Such solvents are known in the art. Examples of organic compounds which form azeotropes with water, their boiling points, the percentage of the organic compound(s) in the azeotrope, the boiling point of the azeotrope at atmospheric pressure and the composition of the water-rich phase and the solvent-rich phase are listed in the CRC Handbook of Chemistry and Physics, 51th edition, 1970–1971, pages D-1 to D-44, published by The Chemical Rubber Co., Ohio.

Table I below lists compounds which have the features i) and ii) described above, their boiling points at atmospheric pressure, some of the flash points, the boiling point of their azeotrope with water at atmospheric pressure, the weight percentage of the solvent in the azeotrope (the residual amount being water) and the weight percentages of the solvent in the water phase and in the solvent phase respectively at room temperature.

TABLE I

| Organic Solvent | Boiling Point (°C.) | Flash Point (°C.) | Boiling Point Azeotrope (°C.) |
|---|---|---|---|
| I-Butoxy-2-propanol | 170.1 | >55 | 98.6 |
| Butyl acetate | 126.5 | 36.6 | 90.7 |
| Butyronitrile | 118 | 26 | 88.7 |
| Cyclohexanol | 161 | 67.7 | 97.8 |
| Cyclohexanone | 155.4 | 44 | 95 |
| Cyclopentanone | 130.7 | 30.5 | 93.5 |
| Diallyl acetal | 150.9 | | 95.3 |
| Dibutyl acetal | 189.9 | | 98.7 |
| Dibutyl amine | 159.6 | 51.6 | 97 |
| Diethyl butyral | 146.3 | | 94.2 |
| Diethylene glycol dibutyl ether | 254 | >100 | 99.8 |
| Diisobutylketone | 168 | 49 | 97 |
| 2,6-Dimethyl-4-heptanol | 178.1 | 72 | 98.5 |
| Dipropyl acetal | 146 | | 95 |
| Dipropylketone | 144 | 40 | 94.3 |
| 2-Ethyl butanol | 146 | 58.3 | 96.7 |
| 2-Ethylbutyl butyrate | 199.6 | >55 | 98.6 |
| Ethylbutyl ketone | 148.5 | 46 | 94.6 |
| Ethyl crotonate | 138 | | 93.5 |
| Ethyl-3-ethoxy propionate | 170 | 82 | 97 |
| 2-Ethyl hexanol | 185 | 81.1 | 99.1 |
| 2-Ethylhexyl acetate | 199 | 82 | 99 |
| 2-Ethylhexyl amine | 169 | 60 | 98.2 |
| 2-Ethylhexyl chloride | 173 | 60 | 97.3 |
| Ethylidene acetone | 123.5 | | 92 |
| Heptane | 98.4 | | 79.2 |
| Hexane | 69 | | 61.6 |
| Hexanol | 158 | 60 | 97.8 |
| 2-Hexanal | 149 | 45 | 95.1 |

TABLE I-continued

| | | | |
|---|---|---|---|
| Hexylacetate | 169.2 | >50 | 97.4 |
| Isobutylalcohol | 108.4 | 37.7 | 89.7 |
| Isopropyl benzene | 152.4 | 46 | 95 |
| 3-Methoxybutylacetate | 171.3 | | 96.5 |
| Methylamyl ketone | 150.5 | 49 | 95.2 |
| n-Methyldibutyl amine | 162.9 | | 96.5 |
| 5-Methyl-2-hexanone | 144 | 43.3 | 94.7 |
| 2-Methyl pentanol | 148 | 57 | 97.2 |
| Methylphenyl carbino | 205 | 96.1 | 99.7 |
| Methylphenyl ketone | 202 | | 99.1 |
| 2,4-Pentanedione | 140.6 | 40.5 | 94.4 |
| 3-Pentanol | 116 | 34.5 | 91.5 |
| 1,2,3,6-Tetrahydro-benzaldehyde | 164 | | 96.9 |
| Tetrahydrobenzonitrile | 195 | | 98.8 |
| 1,4-Thioxane | 149.2 | | 95.6 |
| Undecane | 196 | | 98 |
| Vinyl butyrate | 116.7 | 20 | 87.2 |
| Vinyl crotonate | 134 | | 92 |
| Vinyl 2-ethyl-hexanoate | 185 | 74 | 98.6 |
| Vinyl-2-ethylhexyl ether | 177.7 | 57 | 97.8 |
| Vinyl-2-methyl pentanoate | 148.8 | | 95 |
| M-Xylene | 139 | 25 | 94.5 |

| Organic Solvent | % Solvent in Azeotrope | % Solvent in Water Phase | % Solvent in Solvent Phase |
|---|---|---|---|
| I-Butoxy-2-propanol | 28 | 6.4 | 81 |
| Butyl acetate | 72.9 | 0.68 | 98.8 |
| Butyronitrile | 67.5 | 3.53 | 97.5 |
| Cyclohexanol | 80 | | 95 |
| Cyclohexanone | 38.4 | 2.3 | 92 |
| Cyclopentanone | 58 | 29.3 | 86.2 |
| Diallyl acetal | 59 | 0.7 | 99.3 |
| Dibutyl acetal | 33.7 | 0.03 | 98.8 |
| Dibutyl amine | 49.5 | 0.47 | 93.8 |
| Diethyl butyral | 65.5 | 0.46 | 99.52 |
| Diethylene glycol dibutyl ether | 5.3 | 0.3 | 98.6 |
| Diisobutylketone | 48.1 | 0.05 | 99.25 |
| 2,6-Dimethyl-4-heptanol | 29.6 | 0.06 | 99 |
| Dipropyl acetal | 63.4 | 0.41 | 99.66 |
| Dipropylketone | 59.5 | 0.4 | 99.1 |
| 2-Ethyl butanol | 42 | 0.43 | 95.5 |
| 2-Ethylbutyl butyrate | 25.1 | 0.1 | 99.5 |
| Ethylbutyl ketone | 57.8 | 1.4 | 99.2 |
| Ethyl crotonate | 62 | 0.63 | 98.5 |
| Ethyl-3-ethoxy propionate | 37 | 1.6 | 98.1 |
| 2-Ethyl hexanol | 20 | 0.1 | 97.4 |
| 2-Ethylhexyl acetate | 26.5 | 0.03 | 99.45 |
| 2-Ethylhexyl amine | 36 | 0.25 | 74.7 |
| 2-Ethylhexyl chloride | 45 | 0.1 | 99.9 |
| Ethylidene acetone | 71.4 | 38 | 82.8 |
| Heptane | 87.1 | 0.01 | 99.98 |
| Hexane | 94.4 | 0.01 | 99.98 |
| Hexanol | 32.8 | 0.58 | 92.8 |
| 2-Hexanal | 51.4 | 0.2 | 98.3 |
| Hexylacetate | 39 | 0.05 | 99.4 |
| Isobutylalcohol | 70 | 8.7 | 85 |
| Isopropyl benzene | 56.2 | 0.01 | 99.95 |
| 3-Methoxybutylacetate | 34.6 | 6.2 | 95.9 |
| Methylamyl ketone | 54.6 | 0.43 | 98.5 |
| n-Methyldibutyl amine | 52 | 0.07 | 99.6 |
| 5-Methyl-2-hexanone | 56 | 0.55 | 98.6 |
| 2-Methyl pentanol | 40 | 0.3 | 94.6 |
| Methylphenyl carbinol | 11 | 2.3 | 94.1 |
| Methylphenyl ketone | 18.5 | 0.55 | 98.35 |
| 2,4-Pentanedione | 59 | 16.6 | 95.5 |
| 3-Pentanol | 65 | 5.5 | 90.1 |
| 1,2,3,6-Tetrahydro-benzaldehyde | 40 | 0.51 | 98.98 |
| Tetrahydrobenzonitrile | 21.7 | 0.63 | 99.46 |
| 1,4-Thioxane | 52 | 6.85 | 98.38 |
| Undecane | 28 | 0.01 | 99.99 |
| Vinyl butyrate | 79.6 | 0.3 | 99.7 |
| Vinyl crotonate | 69 | 0.3 | 98.9 |
| Vinyl 2-ethyl-hexanoate | 32 | 0.01 | 99.8 |
| Vinyl-2-ethylhexyl ether | 40.9 | 0.01 | 99.95 |

TABLE I-continued

| | | | |
|---|---|---|---|
| Vinyl-2-methyl pentanoate | 62 | 0.03 | 99.81 |
| M-Xylene | 60 | 0.05 | 99.95 |

TABLE II

| Compounds | Boiling Point (°C.) | Boiling Point Azeotrope (°C.) |
|---|---|---|
| 2-Ethoxyethanol | 135.6 | |
| Vinyl-2-ethylhexyl ether | 177.7 | 97.7 |
| Water | 100 | |
| 2-Methoxyethanol | 124.6 | |
| Vinyl-2-ethylhexyl ether | 177.7 | 97.7 |
| Water | 100 | |

| Compounds | % Composition in Azeotrope | Solvent Phase | Water Phase |
|---|---|---|---|
| 2-Ethoxyethanol | 11 | 0.5 | 17 |
| Vinyl-2-ethylhexyl ether | 38 | 99.4 | 0.1 |
| Water | 51 | 0.1 | 82.9 |
| 2-Methoxyethanol | 4 | 0.2 | 6 |
| Vinyl-2-ethylhexyl ether | 39 | 99.7 | 0.1 |
| Water | 57 | 0.1 | 93.9 |

Another useful ternary system is the combination of water, a hydrocarbon, such as undecane, and an oxygenated organic compound described further below, such as propylene glycol mono n-butyl ether.

The azeotrope preferably consists of at least 5 percent, more preferably of at least 15 percent, and most preferably of at least 25 percent of the organic solvent and up to 95 percent, more preferably up to 85 percent and most preferably up to 75 percent of water, based on the total weight of the azeotrope. The upper limit of the organic solvent in the azeotrope preferably is 80 percent, more preferably 60 percent, most preferably 49 percent, and, accordingly the lower limit of water in the azeotrope preferably is 20 percent, more preferably 40 percent, most preferably 51 percent by weight, based on the total weight of the azeotrope.

The organic solvent preferably has a boiling point above 100° C., more preferably above 150° C. at atmospheric pressure. The organic solvent preferably is non-halogenated. More preferably, the organic solvent contains, most preferably consists of, an oxygenated compound and/or a hydrocarbon. Hydrocarbons preferably contain from 5 to 20, more preferably from 6 to 18, most preferably from 10 to 12 carbon atoms.

Furthermore, the organic solvent preferably has a good cleaning capability for lipophilic compounds, such as oil, grease or hydrocarbons like mineral oils. More preferably, it is fully miscible with mineral oils.

Moreover, the organic solvent is preferably selected such that the surface tension of the cleaning agent used in step i) and the rinsing agent used in step ii) is lower than the surface tension of undiluted water. The reduced surface tension increases the wettability of the articles to be cleaned and rinsed.

The most preferred organic solvents are propylene glycol mono n-butyl ether ("PnB"), propylene glycol mono isobutyl ether("PiB"), propylene glycol mono tertiary butyl ether ("PtB"), propylene glycol mono n-propyl ether ("PnP"), dipropylene glycol mono n-butyl ether ("DPnB"), dipropylene glycol mono n-propyl ether ("DPnP") or dipropylene glycol dimethyl ether ("DMM"). Table III lists some features of these preferred organic solvents.

TABLE III

| | | PnB | PiB | PtB | PnP |
|---|---|---|---|---|---|
| Boiling point | °C. | 170 | 161 | 151 | 150 |
| Solubility at 25° C. | | | | | |
| Solvent in water | % | 5.6 | 4.6 | 14.5 | unlimited[1)] |
| Water in solvent | % | 13.8 | 11.3 | 20.1 | unlimited[2)] |
| Azeotrope | | | | | |
| Boiling point | °C. | 95 | 96 | 95 | 97 |
| Solvent content | % | 30 | 41 | 22 | 40 |
| Surface tension at 25° C.[3)] | | | | | |
| 5% in water | mN/m | 28.8 | | 36.6 | 36.2 |
| Sat. in water | mN/m | | 31.6 | | |
| Flash point | | | | | |
| Solvent | °C. | 63 | 60 | 45 | 53 |
| Solvent sat. with water | °C. | none[4)] | 60 | 59 | |
| Solvent cont. 20% water | °C. | | | | 61 |
| Water sat. with solvent | °C. | none | 64.2 | | |
| Water cont. 10% solvent | °C. | | | 59.1 | 63 |
| Solvent pick up at 25° C.[5)] | | | | | |
| 5% Solvent in water | g | | | | 5.6 |
| Water sat. with solvent | g | 4.1 | 4.4 | 4.0 | |
| Evaporation[6)] | | | | | |
| 5% Solvent in water | min | | | | 29 |
| Solvent sat. in water | min | 16 | 22 | 12 | |

| | | DPnB | DPnP | DMM |
|---|---|---|---|---|
| Boiling point | °C. | 229 | 212 | 175 |
| Solubility at 25° C. | | | | |
| Solvent in water | % | 4.7 | 14.9 | 34.2 |
| Water in solvent | % | 9.0 | 17.7 | 3.8 |
| Azeotrope | | | | |
| Boiling point | °C. | 98 | 98 | 98 |
| Solvent content | % | 3.6 | 10 | 35 |
| Surface tension at 25° C.[3)] | | | | |
| 5% in water | mN/m | | 35.9 | 46.2 |
| Sat. in water | mN/m | 29.8 | 28.9 | |
| Flash point | | | | |
| Solvent | °C. | 111 | 87 | 65 |
| Solvent sat. with water | °C. | none[4)] | none[4)] | |
| Solvent cont. 20% water | °C. | | | |
| Water sat. with solvent | °C. | none | none | 68 |
| Water cont. 10% solvent | °C. | | none | |
| Solvent pick up at 25° C.[5)] | | | | |
| 5% Solvent in water | g | | | 8.2 |
| Water sat. with solvent | g | 3.5 | 4.8 | |
| Evaporation[6)] | | | | |
| 5% Solvent in water | min | | | 44 |
| Solvent sat. in water | min | 19 | 32 | |

[1)]Solubility is 15.0% at 50° C.
[2)]Solubility is 27.3% at 50° C.
[3)]Surface tension of water: 72 mN/m
[4)]Below boiling point of azeotrope
[5)]Pick up of water: 9.3 g
[6)]Evaporation of water: 60 min The amount of liquid that is picked up by rinsed articles is measured as follows: A standardized basket containing metal screws is immersed into the rinsing agent. The weight prior to and after immersion is measured, and the difference is calculated.

The measured evaporation time indicates the time in minutes that is required to evaporate at least 98 percent of the rinsing agent. The evaporation time is measured under the following conditions: The standardized basket containing the metal screws is suspended on a scale, immersed into the rinsing agent and put in a standardized chamber wherein a linear flow of air at 60° C. is maintained.

The flash point of the rinsing agent is measured according to the Pensky-Martens Closed Cup method according to DIN 51758.

The listed mono- and dipropylene glycol ethers have the above-mentioned mandatory features i) and ii), have a good cleaning capability for lipophilic compounds, a boiling point above 100° C. at atmospheric pressure, and provide the desired low surface tension to the cleaning and rinsing agent.

If convenient handling in the cleaning process is desired, the organic solvent is preferably selected such that both the azeotrope and the rinsing agent and, more preferably, also the cleaning agent have a flash point of above 40° C., more preferably of above 55° C., most preferably of above 100° C. If the azeotrope and the rinsing agent both have a flash point of above 55° C., a simple apparatus can be used in the process of the present invention which does not need to be fire-proof or explosion-proof. As indicated in Table III above, propylene glycol mono n-butyl ether and dipropylene glycol mono n-propyl ether mixed with water at various concentrations have a flash point above the boiling point of the azeotrope.

Propylene glycol n-butyl ether is the most preferred organic solvent because it has all mandatory and preferred features above.

In addition to water and the organic solvent described above, the cleaning agent may contain optional additives, provided that they do not have a negative impact on the distillation step III) described further below. Generally their amount is not more than 25 percent, preferably not more than 10 percent, more preferably not more than 5 percent, most preferably not more than 1 percent, based on the total weight of the cleaning agent. However, the cleaning agent should generally not contain a substantial amount of halogenated solvents; this means that the amount of halogenated solvents generally is not more than 5 percent, preferably not more than 2 percent, more preferably not more than 0.5 percent, based on the total weight of the cleaning agent. Most preferably, the cleaning agent does not contain a halogenated solvent.

For example, the cleaning agent may comprise one or more surfactants. Useful surfactants are described in U.S. Pat. No. 5,164,106, column 5, line 61 to column 7, line 19 and European Patent application 0,336,651, page 5, line 16 to page 6, line 14. The surfactant may be anionic, non-ionic, amphoteric or zwitterionic. If the cleaning agent contains a surfactant, its amount generally is from 0.01 to 10 percent, preferably from 0.05 to 5 percent, most preferably from 0.1 to 3 percent, based on the weight of the cleaning agent.

The cleaning agent may contain one or more basic compounds, such as alkali metal hydroxides, carbonates, phosphonates, phosphates, polyphosphates, pyrophosphates, triphosphates, tetrapyrophosphates, metasilicates, polysilicates, and silicates. Sodium and potassium are the most preferred alkali metal ions. Other useful basic compounds are amines. Alternatively, the cleaning agent may contain one or more acidic compounds, for example organic acids, such as formic acid, acetic acid, propionic acid, butanoic acid, or pentanoic acid; or inorganic acids, such as sulfuric acid, hydrochloric acid, or nitric acid. If a basic or acidic compound is comprised in the cleaning agent, its amount generally is from 0.1 to 25 percent, preferably from 0.2 to 15 percent, most preferably from 0.3 to 5 percent, based on the total weight of the cleaning agent.

The cleaning agent may contain a corrosion inhibitor, preferably in an amount of from 10 to 500 ppm, more preferably from 20 to 200 ppm, based on the total weight of the cleaning agent. Corrosion inhibitors are well known in the art, for example nitrites, phosphates, borates, silicaborates, silicates, or amines, for example ammonia, ethylene diamine, hexamethylene tetramine, benzotriazole, or mono-, di- or trialkanol amines, preferably mono- or tri-ethanol amine or propanol amine.

Provided that they do not have a negative impact on the distillation step III), one or more organic solvents may be comprised in the cleaning agent which do not have the mandatory features i) and ii). However, the cleaning agent preferably does not contain such additional organic solvents.

Other known optional additives are preservatives, bactericides, coloring agents or perfumes, however, the cleaning agent preferably does not contain any substantial amount of such additives.

In step I) of the process of the present invention, one or more articles to be cleaned are contacted with the above-described cleaning agent. The cleaning agent can be contacted with the article(s) in a known manner, for example by spraying it on the article(s) or by immersing the article(s) into the cleaning agent. The method of contacting the cleaning agent with the articles is not critical. The articles may be contacted once, twice or several times with one or more cleaning agents. Between two or more cleaning stages the articles can be rinsed with water or, preferably, with the rinsing agent described further below for removing rinsing agent with dissolved contaminants from the articles. The articles are preferably immersed into one or more, more preferably into 1 to 5, containers which are optionally agitated and which contain the above-described cleaning agent. Agitation can for example be achieved by means of a pump, by stirring or by ultrasonic agitation. The temperature in the cleaning step I) preferably is from 20° C. to 98° C., more preferably from 40° C. to 85° C., most preferably from 40° C. to 75° C. Step I) is preferably conducted at atmospheric pressure.

In step II) of the process of the present invention one or more cleaned articles are rinsed with a rinsing agent which contains from 99.99, preferably from 99, more preferably from 98, most preferably from 96 weight percent, to 60, preferably to 65, more preferably to 70 weight percent of water; and from 0.01, preferably from 1, more preferably from 2, most preferably from 4 weight percent, and up to 40, preferably up to 35, more preferably up to 30 weight percent of the organic solvent described in detail above. The percentages of water and the organic solvent are based on the total weight of the rinsing agent. The percentage of the organic solvent in the rinsing agent may be higher than its solubility in water; in this case the rinsing agent is an emulsion.

In the rinsing agent used in the process of the present invention, the total amount of water and the above-described organic solvent generally is at least 90 percent, preferably at least 95 percent, more preferably at least 98 percent, most preferably at least 99.5 percent, based on the total weight of the rinsing agent.

In addition to water and the organic solvent described above, the rinsing agent may contain optional additives, provided that they do not have a negative impact on the distillation step III) described further below. Generally their amount is not more than 10 percent, preferably not more than 5 percent, more preferably not more than 2, most preferably not more than 0.5 percent, based on the total weight of the rinsing agent. Such additives are for example one or more organic solvents which do not have the mandatory features i) and ii) described above. However, the rinsing agent preferably does not contain such additional organic solvents.

The rinsing agent optionally contains a corrosion inhibitor, preferably in an amount of from 10 to 500 ppm, more preferably from 20 to 200 ppm, based on the total weight of the cleaning agent. Corrosion inhibitors are well known in the art, for example nitrites, phosphates, borates, silicaborates, silicates, or amines, for example ammonia, ethylene diamine, hexamethylene tetraamine, benzotriazole, or mono-, di- or trialkanol amines, preferably mono- or tri-ethanol amine or propanol amine.

The rinsing agent generally does not contain more than 0.05 percent, preferably not more than 0.02 percent, more preferably not more than 0.005 percent of high molecular and/or ionic compounds, based on the total weight of the rinsing agent. By "high molecular" is meant a molecular weight above 500. Most preferably, the rinsing agent used in the process of the present invention does not contain any measurable amount of ionic and/or high molecular compounds. Most preferably, the rinsing agent used in the process of the present invention consists of water and the organic solvent described above.

The temperature in the rinsing step II) preferably is from 20° C. to 98° C., more preferably from 40° C. to 85° C., most preferably from 40° C. to 75° C. Step II) is preferably conducted at atmospheric pressure. In step II) one or more cleaned articles are contacted with the above-described rinsing agent. The rinsing agent can be contacted with the article(s) in a known manner, for example by spraying it on the article(s) or by immersing the article(s) into the rinsing agent. The method of contacting the rinsing agent with the cleaned articles is not critical, however, the rinsing agent should remove the cleaning agent used in the previous step to a sufficient degree. The articles may be contacted once, twice or several times with one or more different rinsing agents. The articles are preferably immersed into one or more, more preferably into 1 or 2, containers which are optionally agitated and which contain the above-described rinsing agent. Agitation can for example be achieved by means of a pump, by stirring or by ultrasonic. The articles are then removed from the container. Surprisingly, it has been found that after the rinsing step generally less liquid adheres to the articles when they are rinsed with the above-described rinsing agent than when they are rinsed with water alone. This is particularly the case when the organic solvent comprised in the rinsing agent is propylene glycol mono n-butyl ether, propylene glycol mono isobutyl ether or propylene glycol mono tertiary. butyl ether. Even when a small amount of an above-described organic solvent is mixed with water, for example up to 15 weight percent, the amount of liquid picked up generally is only up to about 95 percent, typically only up to about 65 percent, in several cases only up to about 50 percent of the amount of liquid that is picked up when the articles are rinsed with water alone. Accordingly, the energy consumption required for evaporation of the liquid, that means for drying the article(s) in the subsequent optional step IV), is considerably decreased.

In step III) of the process of the present invention at least a portion, preferably the entire amount, of the cleaning agent used in step I) and at least a portion, preferably the entire amount, of the rinsing agent used in step II) are combined and the combined liquid is subjected to an azeotropic distillation. The combined distillation of the cleaning agent and the rinsing agent is very cost-efficient and simplifies the process of the present invention because only one distillation device is required. Useful distillation devices are known in the art. The distillation is preferably conducted at a temperature of from 20° C. to 99° C., more preferably from 85° C. to 99° C. The distillation is preferably conducted at atmospheric pressure. It can also be conducted at reduced pressure, preferably at a pressure of from 10 to 900 mbar, more preferably from 20 to 500 mbar. As indicated above, the organic solvent in the cleaning agent and the rinsing agent is chosen such that an azeotropic mixture of the organic solvent and water is distilled. As mentioned above, the azeotrope preferably consists of at least 5 percent, more preferably of at least 15 percent, and most preferably of at least 25 percent of the organic solvent and up to 95 percent, more preferably up to 85 percent and most preferably up to 75 percent of water, based on the total weight of the azeotrope. Preferably, the liquid which is subjected to the azeotropic distillation contains an excess of water, that means the liquid contains water in such an amount that water is left at the bottoms of the distillation column when substantially all organic solvent has been distilled off. When the distillation of the azeotrope is complete, water, washed off contaminants, such as oils, and above-described high molecular or ionic additives, which are optionally comprised in the cleaning agent and/or in the rinsing agent, are generally left at the bottoms of the distillation column. This residue can be subjected to further processing, such as separation, purification and optional recycling to the cleaning process.

The distilled azeotrope is condensed, preferably by cooling to a temperature of from 90° C. to 5° C., more preferably of from 75° C. to 40° C. Useful condensers are known in the art. The condenser may be integrated in the liquid/liquid separator mentioned below. The condenser may be cooled with a liquid, such as water, or with a gas, such as air. The heat generated in the cooling process can be used in the subsequent optional drying process, for example for drying the clean articles with heated air.

The condensate is separated in a liquid/liquid separator into a water-rich phase and a solvent-rich phase. The temperature in this separation step preferably is from 20° C. to 98° C., more preferably from 40° C. to 85° C., most preferably from 40° C. to 75° C. The temperature in the separation step is preferably about the same as the temperature of the rinsing agent in the rinsing step II). Useful separation devices are known in the art, for example decanters or liquid/liquid centrifuges. The liquid in the separation device may function as a condenser for condensing the distilled azeotrope.

The solvent-rich phase contains minor amounts of dissolved water, and the water-rich phase contains minor amounts of dissolved organic solvent, whereby these amounts usually depend on the temperature. At a temperature of about 65° C., the solvent-rich phase preferably contains from 0.1 to 35 weight percent, more preferably from 1 to 20 weight percent and most preferably from 3 to 15 weight percent of dissolved water; and the water-rich phase preferably contains from 0.1 to 35 weight percent, more preferably from 0.5 to 20 weight percent and most preferably from 1 to 15 weight percent of dissolved organic solvent.

Generally the solvent-rich phase can be used without modification in the cleaning step I) and the water-rich phase can be used without modification in the rinsing step II). This is one of the main advantages of the above-listed preferred organic solvents, particularly propylene glycol mono n-butyl ether.

If desired, optional additives described in more detail above can be added to the solvent-rich phase and/or to the water-rich phase before they are re-used as cleaning and rinsing agents in steps I) and II).

In optional step IV) the rinsed articles are dried. The temperature during the drying step preferably is from 20° C. to 250° C., more preferably from 20° C. to 150° C., most preferably from 40° C. to 100° C. Preferably, the drying temperature is at least 15° C. lower than the flash point of the rinsing agent. Evaporated rinsing agent may be vented or recovered in a known manner, for example by condensation. Drying is advantageously conducted at ambient or reduced pressure. At least when using one of the above-listed mono- or dipropylene glycol ethers as an organic solvent, the rinsing agent used in the process of the present invention evaporates more quickly than water alone. Even when a small amount of such an organic solvent is mixed with water, for example up to 15 weight percent, the drying time generally is only up to about 90 percent, typically only up to about 70 percent, in several cases even only up to about 50 percent of the drying time that is required when the articles are rinsed with water alone. The reduced drying time reduces the costs of drying wet articles. The articles are preferably dried in a gas stream, such as a stream of nitrogen or air.

The process of the present invention can be run in batches or, preferably, continuously.

Preferred embodiments of the process and cleaning apparatus of the present invention are described in detail in Examples 1 and 2 with reference to the drawing. The Examples should not be construed to limit the scope of the present invention. Unless stated otherwise, all parts and percentages are given by weight.

EXAMPLE 1

The cleaning apparatus contained two cleaning vessels 1 and 2 which contain a saturated solution of water in propylene glycol mono n-butyl ether as a cleaning agent. The cleaning apparatus contained a rinsing vessel 3 which contained a saturated solution of propylene glycol mono n-butyl ether in water as a rinsing agent. Furthermore, the cleaning apparatus contained a distillation device 4, a condenser 5, a liquid/liquid separator 6, a drying device 7, optionally a gas purification device 8 and optionally a cooler 9.

When the cleaning apparatus was in operation, articles to be cleaned (not shown) were first immersed into the cleaning vessel 1 and then into the cleaning vessel 2. The temperature of the cleaning agent in the cleaning vessels preferably was about 65° C. At this temperature the concentration of water in propylene glycol mono n-butyl ether was about 12 percent. The cleaned articles are then passed into the rinsing vessel 3. The temperature of the rinsing agent in the rinsing vessel preferably was also about 65° C. At this temperature the concentration of propylene glycol mono n-butyl ether in water was about 4.5 weight percent. The rinsed articles were removed from the rinsing vessel and passed to the drying device 7 where they were dried with heated air 12. The temperature of the heated air preferably is about 70° C. The evaporated rinsing agent may be passed through a gas purification device 8.

When the cleaning agent in the cleaning vessel 1 contained a certain amount of impurities, a portion or the entire amount of the cleaning agent was fed into the distillation device 4. A portion or the entire amount of cleaning agent in the cleaning vessel 2 can be fed into the cleaning vessel 1 for further usage. Alternatively, a portion of all of the cleaning agent in the cleaning vessel 2 can be directly fed into the distillation device 4 after usage. Rinsing agent was fed from the rinsing vessel into the distillation device 4. Depending on the amount of cleaning agent and rinsing agent fed into the distillation device 4, an additional amount of water was fed into the distillation device such that the amount of water in the distillation device was higher than the amount of water that was distilled off during the azeotropic distillation. Furthermore, water and organic solvent were periodically or continuously added to the distillation device to replace the evaporated rinsing agent. The boiling point of the azeotrope was about 97° C. at atmospheric pressure. It consisted of about 30 weight percent of propylene glycol mono n-butyl ether and about 70 weight percent of water. The azeotrope was cooled in a condenser 5, preferably to a temperature of about 65° C. The heat generated in the condenser 5 was used for heating the air 12 used for drying the articles in the drying device 7. The condensed liquid was fed into the liquid/liquid separator 6, where it was separated into a water-rich phase 10 and a solvent-rich phase 11. The solvent-rich phase was recycled to the cleaning tank 2 where it was used for cleaning purposes. The water-rich phase 10 was recycled to the rinsing tank 3 and used for rinsing cleaned articles. A portion of the water-rich phase was preferably cooled in a cooler 9, used for scrubbing the evaporated rinsing agent and recycled to the distillation device 4.

EXAMPLE 2

The same cleaning apparatus as in Example 1 was used and the process was carried out in the same manner as in Example 1. However, the cleaning vessels 1 and 2 contained a saturated solution of water in an organic solvent as a cleaning agent. The organic solvent was a mixture of about 10 percent of propylene glycol mono n-butyl ether and about 90 percent of undecane. The rinsing vessel 3 contained a saturated solution of the above-mentioned organic solvent in water as a rinsing agent.

The temperature of the cleaning agent in the cleaning vessels preferably is about 40° C. At this temperature the concentration of water in the organic solvent was about 1 percent. The temperature of the rinsing agent in the rinsing vessel preferably was about 65° C. At this temperature the concentration of the organic solvent in water was about 4 percent.

What is claimed is:

1. A process for cleaning one or more articles comprising the steps of:

I) contacting the article(s) with a cleaning agent containing
  a) from 0.01 to 80 weight percent of water and
  b) from 99.99 to 20 weight percent of an organic solvent having the features of:
    i) forming an azeotrope with water, and
    ii) forming a separate phase after azeotropic distillation,
  the percentages of a) and b) being based on the total weight of a) and b);

II) rinsing one or more cleaned articles with a rinsing agent containing from 99.99 to 60 weight percent of water and from 0.01 to 40 weight percent of said organic solvent, based on the total weight of the rinsing agent, whereby the rinsing agent has a higher water content than the cleaning agent; and III) combining at least a portion of the cleaning agent used in step I) and at least a portion of the rinsing agent used in step II) and subjecting the combined cleaning agent and rinsing agent to an azeotropic distillation to recover an azeotrope, separating the azeotrope into a water-rich phase and a solvent-rich phase and recycling at least a portion of the solvent-rich phase to step I) and recycling at least a portion of the water-rich phase to step II).

2. The process of claim 1 comprising the additional step of IV) drying the rinsed article(s).

3. The process of claim 2 wherein both the azeotrope and the rinsing agent have a flash point of above 40° C.

4. The process of claim 1 wherein both the azeotrope and the rinsing agent have a flash point of above 40° C.

5. The process of claim 4 wherein the organic solvent is non-halogenated.

6. The process of claim 4 wherein the organic solvent contains a compound selected from the group consisting of oxygenated compounds, hydrocarbons and blends thereof.

7. The process of claim 4 wherein:

the cleaning agent contains a) from 1 to 60 weight percent of water and b) from 99 to 40 weight percent of said organic solvent, based on the total weight of a) and b), and the rinsing agent contains from 99 to 65 weight percent of water and from 1 to 35 weight percent of said organic solvent, based on the total weight of the rinsing agent.

8. The process of claim 4 wherein in step I) at least one article is contacted with the cleaning agent, the article is rinsed with water or with the rinsing agent, the article is again contacted with the cleaning agent and the article is subsequently rinsed in step II) with the rinsing agent.

9. The process of claim 1 wherein the organic solvent is non-halogenated.

10. The process of claim 1 wherein the organic solvent contains a compound selected from the group consisting of oxygenated compounds, hydrocarbons and blends thereof.

11. The process of claim 10 wherein the oxygenated compound is propylene glycol mono n-butyl ether, propylene glycol mono isobutyl ether, propylene glycol mono tertiary. butyl ether, propylene glycol mono n-propyl ether, dipropylene glycol mono n-propyl ether or dipropylene glycol dimethyl ether.

12. The process of claim 11 wherein:

the cleaning agent contains a) from 1 to 60 weight percent of water and b) from 99 to 40 weight percent of said organic solvent, based on the total weight of a) and b), and the rinsing agent contains from 99 to 65 weight percent of water and from 1 to 35 weight percent of said organic solvent, based on the total weight of the rinsing agent.

13. The process of claim 11 wherein in step I) at least one article is contacted with the cleaning agent, the article is rinsed with water or with the rinsing agent, the article is again contacted with the cleaning agent and the article is subsequently rinsed in step II) with the rinsing agent.

14. The process of claim 1 wherein:

the cleaning agent contains a) from 1 to 60 weight percent of water and b) from 99 to 40 weight percent of said organic solvent, based on the total weight of a) and b), and the rinsing agent contains from 99 to 65 weight percent of water and from 1 to 35 weight percent of said organic solvent, based on the total weight of the rinsing agent.

15. The process of claim 1 wherein in step I) at least one article is contacted with the cleaning agent, the article is rinsed with water or with the rinsing agent, the article is again contacted with the cleaning agent and the article is subsequently rinsed in step II) with the rinsing agent.

* * * * *